US011348445B2

(12) United States Patent
Law

(10) Patent No.: US 11,348,445 B2
(45) Date of Patent: May 31, 2022

(54) PERSONAL ALARM SYSTEM

(71) Applicant: Law Law & Law Pty Ltd, Dianella (AU)

(72) Inventor: James Frank Law, Dianella (AU)

(73) Assignee: Law Law & Law Pty Ltd, Dianella (AU)

( * ) Notice: Subject to any disclaimer, the term of this patent is extended or adjusted under 35 U.S.C. 154(b) by 0 days.

(21) Appl. No.: 16/607,965

(22) PCT Filed: May 1, 2018

(86) PCT No.: PCT/AU2018/050399

§ 371 (c)(1),
(2) Date: Oct. 24, 2019

(87) PCT Pub. No.: WO2018/201188

PCT Pub. Date: Nov. 8, 2018

(65) Prior Publication Data

US 2020/0410843 A1 Dec. 31, 2020

(30) Foreign Application Priority Data

May 3, 2017 (AU) ..... 2017901610
Jun. 23, 2017 (AU) ..... 2017902423

(51) Int. Cl.
*G08B 25/01* (2006.01)
*G08B 21/02* (2006.01)
*G08B 25/10* (2006.01)

(52) U.S. Cl.
CPC ..... *G08B 25/016* (2013.01); *G08B 21/02* (2013.01); *G08B 25/10* (2013.01)

(58) Field of Classification Search
CPC combination set(s) only.
See application file for complete search history.

(56) References Cited

U.S. PATENT DOCUMENTS 6,147,611 A * 11/2000 Otero ..... G08B 5/002 340/573.1
2008/0182547 A1* 7/2008 Glover ..... H04M 11/04 455/404.1

(Continued)

OTHER PUBLICATIONS

International Search Report; prepared for application No. PCT/AU2018/050399; authorized officer Bayer Mitrovic; dated Jul. 17, 2018; 3 pages.

*Primary Examiner* — Thomas S McCormack
(74) *Attorney, Agent, or Firm* — Winstead PC

(57) ABSTRACT

Provided is a distributed personal alarm system (10), which comprises a monitoring arrangement (12) and a plurality of mobile monitors (24). The monitoring arrangement (12) comprises a user database (14), a receiver (16) configured to receive a distress signal via a communications network (200), and a dispatcher (18) configured to dispatch emergency assistance (30) upon receipt of a distress signal. The alarm system (10) generally includes at least one mobile monitor (24) pre-associated with a user profile (26) stored in the user database (14). The monitor (24) is further configured to generate and transmit the distress signal via the communications network (200), wherein the signal is indicative of the user profile (26) and a geospatial position (28) of the mobile monitor (24).

17 Claims, 4 Drawing Sheets

(56) References Cited

U.S. PATENT DOCUMENTS

| | | | | |
|---|---|---|---|---|
| 2009/0322513 | A1* | 12/2009 | Hwang | G06F 19/3418 340/539.12 |
| 2012/0157037 | A1 | 6/2012 | Hoffman et al. | |
| 2014/0308915 | A1 | 10/2014 | Reitnour et al. | |
| 2015/0269827 | A1* | 9/2015 | Hopkins | G08B 21/0227 340/539.12 |
| 2015/0271655 | A1* | 9/2015 | Jatavallabhula | H04W 4/90 455/404.1 |
| 2015/0288797 | A1* | 10/2015 | Vincent | G16H 40/67 455/404.2 |

* cited by examiner

PERSONAL ALARM SYSTEM

TECHNICAL FIELD

This invention relates to a distributed personal alarm system, an alarm monitoring method, and an associated mobile monitor for a personal alarm.

BACKGROUND ART

The following discussion of the background art is intended to facilitate an understanding of the present invention only. The discussion is not an acknowledgement or admission that any of the material referred to is or was part of the common general knowledge as at the priority date of the application.

In the field of security, security systems are often installed within homes and businesses in an effort to prevent crime. Some systems may be adapted to sound an alarm upon detection of an intruder at a door or a window, notifying individuals inside and/or outside the home or business that an unwanted individual may have entered. In some cases, systems may be additionally or alternatively adapted to automatically notify emergency personnel, such as the police department of the region in which the home or business is located, for example. In this manner, help may be sent to the home or business quickly. Since such systems are generally configured to remain within the home or business, however, the systems may not offer security for individuals when they are away from the home or business.

Similarly, in the field of medicine, there is often a need for individuals with certain medical conditions, or elderly individuals, to have a means to raise an alarm when assistance is required, particularly where such individuals are not subjected to ongoing medical monitoring such as in a hospital or medical facility.

For example, an individual with a certain medical condition, or someone walking alone at night or in a secluded area, may desire to have a manner with which to sound an alarm and/or automatically contact emergency personnel upon requiring medical attention or being attacked. In other cases, individuals who need the attention of responsive personnel at unexpected times, such as when they are unable to summon assistance themselves, may want a means whereby assistance may be summoned, irrespective of their locations.

In particular, it is not uncommon to hear reports of deceased individuals, who lived alone, being found some time after they have passed away. Statistics show that increasing numbers of elderly people are living alone. Coroner reports have found that, in certain cases, people who lived alone and suffered a medical emergency may have been saved if there was some manner in which the medical emergency could have been identified and the alarm raised.

The present invention seeks to propose possible solutions, at least in part, in amelioration of the known shortcomings in this field.

SUMMARY OF THE INVENTION

According to a first aspect of the invention there is provided a distributed personal alarm system comprising:

a monitoring arrangement comprising a user database, a receiver configured to receive a distress signal via a communications network, and a dispatcher configured to dispatch emergency assistance upon receipt of a distress signal; and at least one mobile monitor pre-associated with a user profile in the user database, the monitor configured for convenient mobility on a user's person, and to generate and transmit the distress signal via the communications network, said signal indicative of the user profile and a geospatial position of the mobile monitor.

In one example, the monitoring arrangement comprises a processing system having a processor, a memory arrangement and a communications network interface.

Typically, the memory arrangement houses the user database for storing a plurality of user profiles, each associated with an independent mobile monitor.

In one example, the memory arrangement includes a set of instructions which, when executed by the processor, enables the monitoring arrangement to perform its functions.

Typically, the receiver comprises the network communications interface for interfacing with the communications network.

Typically, the communications network comprises a mobile telephony network, the internet or World Wide Web, and/or a radio network.

In one example, the monitoring arrangement is configured to provide an electronic portal whereby a user is able to register a user profile on the user database, and to associate a particular mobile monitor with such profile.

Typically, the distress signal generated by the mobile monitor comprises an identifier for uniquely identifying the user profile.

In one example, the distress signal generated by the mobile monitor is indicative of a type of emergency assistance required by the user.

In one example, the emergency assistance dispatched by the dispatcher upon receipt of the distress signal is dependent on a pre-registered emergency assistance requirement registered on the user profile.

Typically, a type of emergency assistance is selected from a group consisting of medical assistance, police assistance, fire services and private security assistance.

In one example, the dispatcher comprises a call centre.

In another example, the dispatcher comprises the processing system which has been configured to automatically dispatch the emergency assistance.

In one example, the mobile monitor includes a global navigation satellite system (GNSS) sensor to facilitate indication of the geospatial position of the mobile monitor.

In another example, the monitoring arrangement and/or communications network is configured to radiolocate the geospatial position of the mobile monitor based on reception of the distress signal. The skilled addressee will appreciate that radiolocation and its derivatives generally refer to the determination of a position of an object, such as the mobile monitor, by means of the propagation properties of electromagnetic waves, such as the distress signal, and include any suitable radiodetermination techniques.

In one example, the mobile monitor is configured to generate the distress signal in accordance with the global navigation satellite system (GNSS) sensor sensing that the geospatial position is outside of a preconfigured geo-fence associated with the user profile on the user database.

In one example, the monitoring arrangement is configured to dispatch emergency assistance upon detecting that the geospatial position is outside a preconfigured geo-fence associated with the user profile on the user database.

In one example, the mobile monitor is configured to generate the distress signal in accordance with passing a geo-fence boundary operatively establishing a geo-fence associated with the user profile on the user database.

In one example, the mobile monitor is configured for convenient mobility on a user's person by comprising a software application running on a mobile handset of the user.

In another example, the mobile monitor is configured for convenient mobility on a user's person by comprising a device wearable by the user.

Typically, the mobile monitor comprises a watch-type device wearable on the user's wrist. In another example, the mobile monitor comprises a pendant-type device wearable around the user's neck.

In one example, the mobile monitor is configured to interface with a mobile handset of the user via frequency-hopping spread spectrum electromagnetic wave technology, e.g. Bluetooth, or the like.

In one example, the mobile monitor is configured to generate the distress signal upon direct user input.

In one example, the mobile monitor includes a microphone with the user input being a user-programmable emergency phrase which causes the mobile monitor to generate the distress signal.

In one example, the mobile monitor includes an activating switch so that a user is able to manually activate generation of the distress signal.

In one example, the mobile monitor includes a detector for sensing a particular medical condition of the user, detection of which causes automatic generation of the distress signal.

Typically, the detector may be configured to detect a user's heart-rate, blood pressure, blood sugar levels, electrical impulses, and/or the like.

In one example, the mobile monitor includes a camera configured to transmit an image to the monitoring arrangement.

In one example, the mobile monitor includes a display configured to receive an image from the monitoring arrangement.

In one example, the mobile monitor includes a notifier configured to notify the user of an occurrence.

Typically, the notifier includes an audible and/or visual and/or haptic notification means.

In one example, the occurrence comprises the detector sensing a particular medical condition.

In another example, the occurrence comprises a notification from the monitoring arrangement.

In a yet further example, the occurrence comprises an automatic and scheduled reminder notification for taking medication.

Typically, the mobile monitor includes an inclinometer configured to detect a change and/or a rate of change in orientation of the user's person, detection of a specific change and/or rate of change which causes automatic generation of the distress signal.

According to a second aspect of the invention there is provided an alarm monitoring method comprising the steps of:

providing a monitoring arrangement comprising a user database, a receiver configured to receive a distress signal via a communications network, and a dispatcher configured to dispatch emergency assistance upon receipt of a distress signal, and monitoring said communications network for distress signals;

providing at least one mobile monitor pre-associated with a user profile in the user database, the monitor configured for convenient mobility on a user's person, and to generate and transmit the distress signal via the communications network, said signal indicative of the user profile and a geospatial position of the mobile monitor; and upon receipt of a distress signal by the monitoring arrangement, dispatching emergency assistance to the geospatial position of the mobile monitor.

In one example, the step of providing the monitoring arrangement comprises providing a processing system having a processor, a memory arrangement and a communications network interface.

Typically, the memory arrangement houses the user database for storing a plurality of user profiles, each associated with an independent mobile monitor.

In one example, the memory arrangement includes a set of instructions which, when executed by the processor, enables the monitoring arrangement to perform its functions.

Typically, the receiver comprises the network communications interface for interfacing with the communications network.

Typically, the communications network comprises a mobile telephony network, the internet or World Wide Web, and/or a radio network.

In one example, the monitoring arrangement is configured to provide an electronic portal whereby a user is able to register a user profile on the user database, and to associate a particular mobile monitor with such profile.

Typically, the distress signal generated by the mobile monitor comprises an identifier for uniquely identifying the user profile.

In one example, the distress signal generated by the mobile monitor is indicative of a type of emergency assistance required by the user.

In one example, the emergency assistance dispatched by the dispatcher upon receipt of the distress signal is dependent on a pre-registered emergency assistance requirement registered on the user profile.

Typically, a type of emergency assistance is selected from a group consisting of medical assistance, police assistance, fire services and private security assistance.

In one example, the dispatcher comprises a call centre.

In another example, the dispatcher comprises the processing system which has been configured to automatically dispatch the emergency assistance.

In one example, the mobile monitor includes a global navigation satellite system (GNSS) sensor to facilitate indication of the geospatial position of the mobile monitor.

In another example, the monitoring arrangement and/or communications network is configured to radiolocate the geospatial position of the mobile monitor based on reception of the distress signal.

In one example, the mobile monitor is configured to generate the distress signal in accordance with the global navigation satellite system (GNSS) sensor sensing that the geospatial position is outside of a preconfigured geo-fence associated with the user profile on the user database.

In one example, the monitoring arrangement is configured to dispatch emergency assistance upon detecting that the geospatial position is outside a preconfigured geo-fence associated with the user profile on the user database.

In one example, the mobile monitor is configured to generate the distress signal in accordance with passing a geo-fence boundary operatively establishing a geo-fence associated with the user profile on the user database.

In one example, the mobile monitor is configured for convenient mobility on a user's person by comprising a software application running on a mobile handset of the user.

In another example, the mobile monitor is configured for convenient mobility on a user's person by comprising a device wearable by the user.

Typically, the mobile monitor includes an inclinometer configured to detect a change and/or a rate of change in orientation of the user's person, detection of a specific change and/or rate of change which causes automatic generation of the distress signal.

Typically, the mobile monitor comprises a watch-type device wearable on the user's wrist. In another example, the mobile monitor comprises a pendant-type device wearable around the user's neck.

In one example, the mobile monitor is configured to interface with a mobile handset of the user via frequency-hopping spread spectrum electromagnetic wave technology.

In one example, the mobile monitor is configured to generate the distress signal upon direct user input.

In one example, the mobile monitor includes a microphone with the user input being a user-programmable emergency phrase which causes the mobile monitor to generate the distress signal.

In one example, the mobile monitor includes an activating switch so that a user is able to manually activate generation of the distress signal.

In one example, the mobile monitor includes a detector for sensing a particular medical condition of the user, detection of which causes automatic generation of the distress signal.

Typically, the detector may be configured to detect a user's heart-rate, blood pressure, blood sugar levels, electrical impulses, and/or the like.

In one example, the mobile monitor includes a camera configured to transmit an image to the monitoring arrangement.

In one example, the mobile monitor includes a display configured to receive an image from the monitoring arrangement.

In one example, the mobile monitor includes a notifier configured to notify the user of an occurrence.

Typically, the notifier includes an audible and/or visual and/or haptic notification means.

In one example, the occurrence comprises the detector sensing a particular medical condition.

In another example, the occurrence comprises a notification from the monitoring arrangement.

In a yet further example, the occurrence comprises an automatic and scheduled reminder notification for taking medication.

According to a third aspect of the invention there is provided a mobile monitor for a personal alarm system, said mobile monitor comprising:

- a housing configured for convenient mobility on a user's person; and
- a processing system arranged within the housing, said processing system configured to enable generation and subsequent transmission of a distress signal via a communications network, said signal indicative of a profile of the user pre-registered on a user database of an associated monitoring arrangement having a dispatcher configured to dispatch emergency assistance upon receipt of said distress signal, the distress signal further indicative of a geospatial position of the mobile monitor.

Typically, the communications network comprises a mobile telephony network, the internet or World Wide Web, and/or a radio network.

Typically, the distress signal generated by the mobile monitor comprises an identifier for uniquely identifying the user profile.

In one example, the distress signal generated by the mobile monitor is indicative of a type of emergency assistance required by the user.

In one example, the mobile monitor includes a global navigation satellite system (GNSS) sensor to facilitate indication of the geospatial position of the mobile monitor.

In one example, the mobile monitor is configured to generate the distress signal in accordance with the global navigation satellite system (GNSS) sensor sensing that the geospatial position is outside of a preconfigured geo-fence associated with the user profile on the user database.

In one example, the mobile monitor is configured to generate the distress signal in accordance with passing a geo-fence boundary operatively establishing a geo-fence associated with the user profile on the user database.

In one example, the mobile monitor is configured for convenient mobility on a user's person by comprising a software application running on a mobile handset of the user.

In another example, the mobile monitor is configured for convenient mobility on a user's person by comprising a device wearable by the user.

Typically, the mobile monitor includes an inclinometer configured to detect a change and/or a rate of change in orientation of the user's person, detection of a specific change and/or rate of change which causes automatic generation of the distress signal.

Typically, the mobile monitor comprises a watch-type device wearable on the user's wrist. In another example, the mobile monitor comprises a pendant-type device wearable around the user's neck.

In one example, the mobile monitor is configured to interface with a mobile handset of the user via frequency-hopping spread spectrum electromagnetic wave technology, e.g. Bluetooth, or the like.

In one example, the mobile monitor is configured to generate the distress signal upon direct user input.

In one example, the mobile monitor includes a microphone with the user input being a user-programmable emergency phrase which causes the mobile monitor to generate the distress signal.

In one example, the mobile monitor includes an activating switch so that a user is able to manually activate generation of the distress signal.

In one example, the mobile monitor includes a detector for sensing a particular medical condition of the user, detection of which causes automatic generation of the distress signal.

Typically, the detector may be configured to detect a user's heart-rate, blood pressure, blood sugar levels, electrical impulses, and/or the like.

In one example, the mobile monitor includes a camera configured to transmit an image to the monitoring arrangement.

In one example, the mobile monitor includes a display configured to receive an image from the monitoring arrangement.

In one example, the mobile monitor includes a notifier configured to notify the user of an occurrence.

Typically, the notifier includes an audible and/or visual and/or haptic notification means.

In one example, the occurrence comprises the detector sensing a particular medical condition.

In another example, the occurrence comprises a notification from the monitoring arrangement.

In a yet further example, the occurrence comprises an automatic and scheduled reminder notification for taking medication.

BRIEF DESCRIPTION OF THE DRAWINGS

The description will be made with reference to the accompanying drawings in which.

DETAILED DESCRIPTION OF EMBODIMENTS

Figure 1:
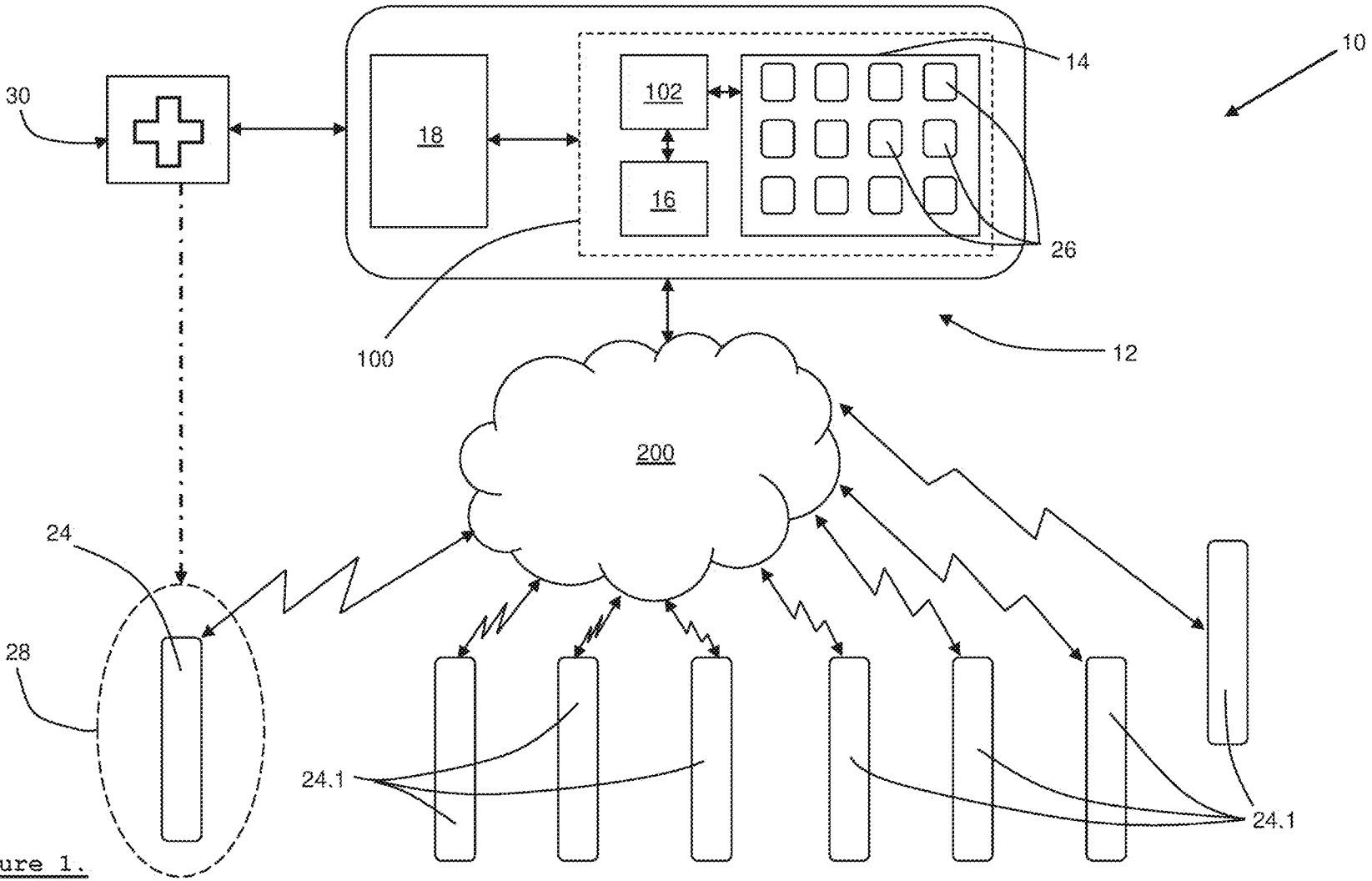
FIG. 1 is a diagrammatic representation of one embodiment of a personal alarm system, in accordance with an aspect of the invention.

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above. In the figures, incorporated to illustrate features of the example embodiment or embodiments, like reference numerals are used to identify like parts throughout.

It is to be appreciated that any reference herein to "means" specifically includes any one or more of a computer program product for use in a local or dispersed computing system, a computer readable modulated carrier signal for interpretation by a local or dispersed computing system, or a computer readable medium of instructions for enabling a local or dispersed computing system to provide such "means" within the context of the description. In addition, such "means" may further expressly comprise any of the hardware and/or software components, independently or in combination, provided for in the description below, as will be understood by the skilled addressee.

With reference now to the accompanying drawings, there is shown one example of a distributed personal alarm system 10. In this example, the alarm system 10 in comprises a monitoring arrangement 12 and a plurality of mobile monitors 24. One aspect of the present example includes at least one mobile monitor 24, but a typical example general features a plurality of such mobile monitors 24.1, as shown.

Broadly, the monitoring arrangement 12 comprises a user database 14, a receiver 16 configured to receive a distress signal via a communications network 200, and a dispatcher 18 configured to dispatch emergency assistance 30 upon receipt of a distress signal.

Similarly, the alarm system 10 generally includes at least one mobile monitor 24 pre-associated with a user profile 26 stored in the user database 14. The monitor 24 is further configured to generate and transmit the distress signal via the communications network 200, wherein the signal is indicative of the user profile 26 and a geospatial position 28 of the mobile monitor 24. Importantly, the monitor 24 is also configured for convenient mobility on a user's person, described in more detail below.

In a typical example, both the monitoring arrangement 14 and the mobile monitor 24 comprise a suitably adapted processing system 10 (described in more detail below with reference to FIG. 2) having a processor 102, a memory arrangement 104, a storage device 114 and a communications network interface 112 (similar to interface 16).

Typically, the memory arrangement 104 and/or storage device 114 houses the user database 14, 116 for storing a plurality of user profiles 26, with each user profile 26 associated with an independent mobile monitor 24. In one example, the memory arrangement 104, 114 includes a set of instructions which, when executed by the processor 102, enables the monitoring arrangement 12 to perform its functions.

Figure 2:
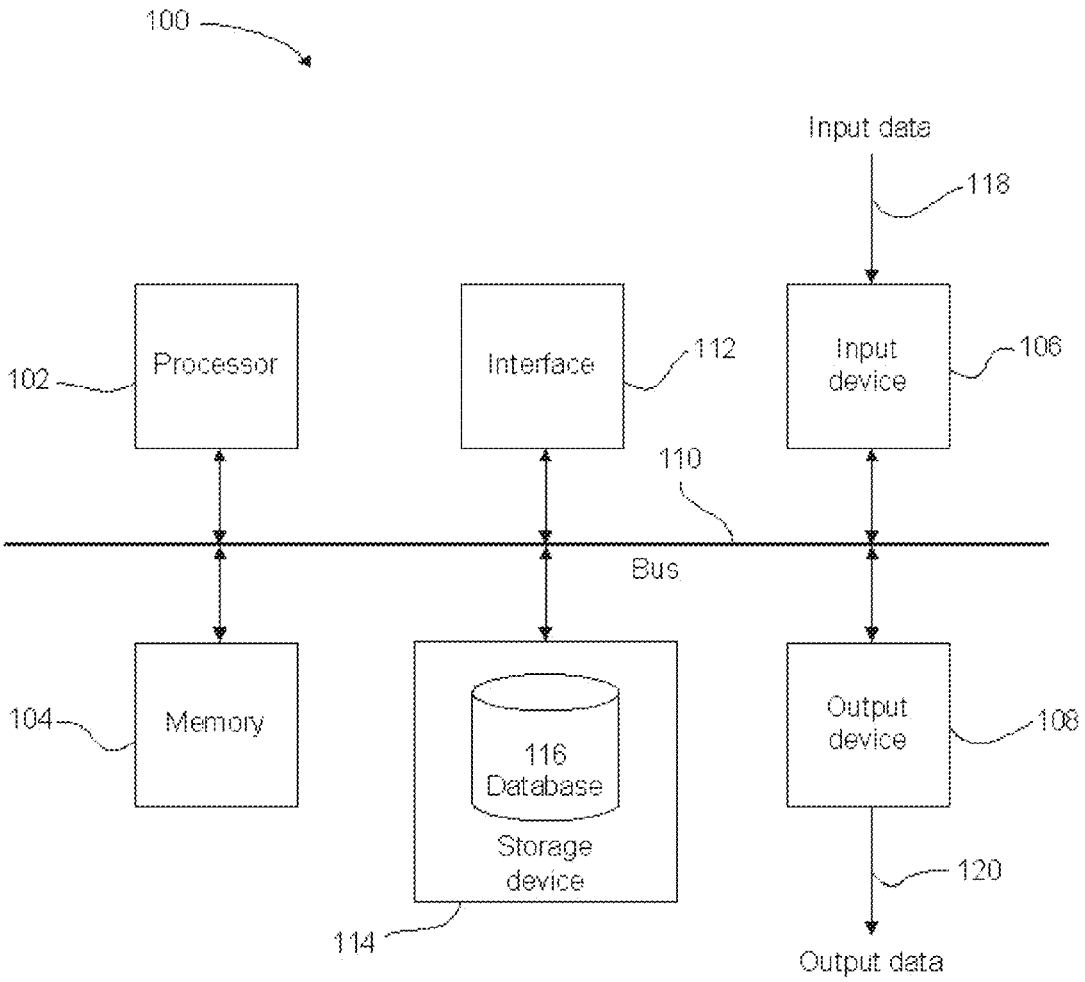
FIG. 2 illustrates a functional block diagram of an example processing system that can be utilised to embody or give effect to a particular embodiment of the monitoring arrangement and/or the mobile monitor of the personal alarm system of FIG. 1.
Figure 3:
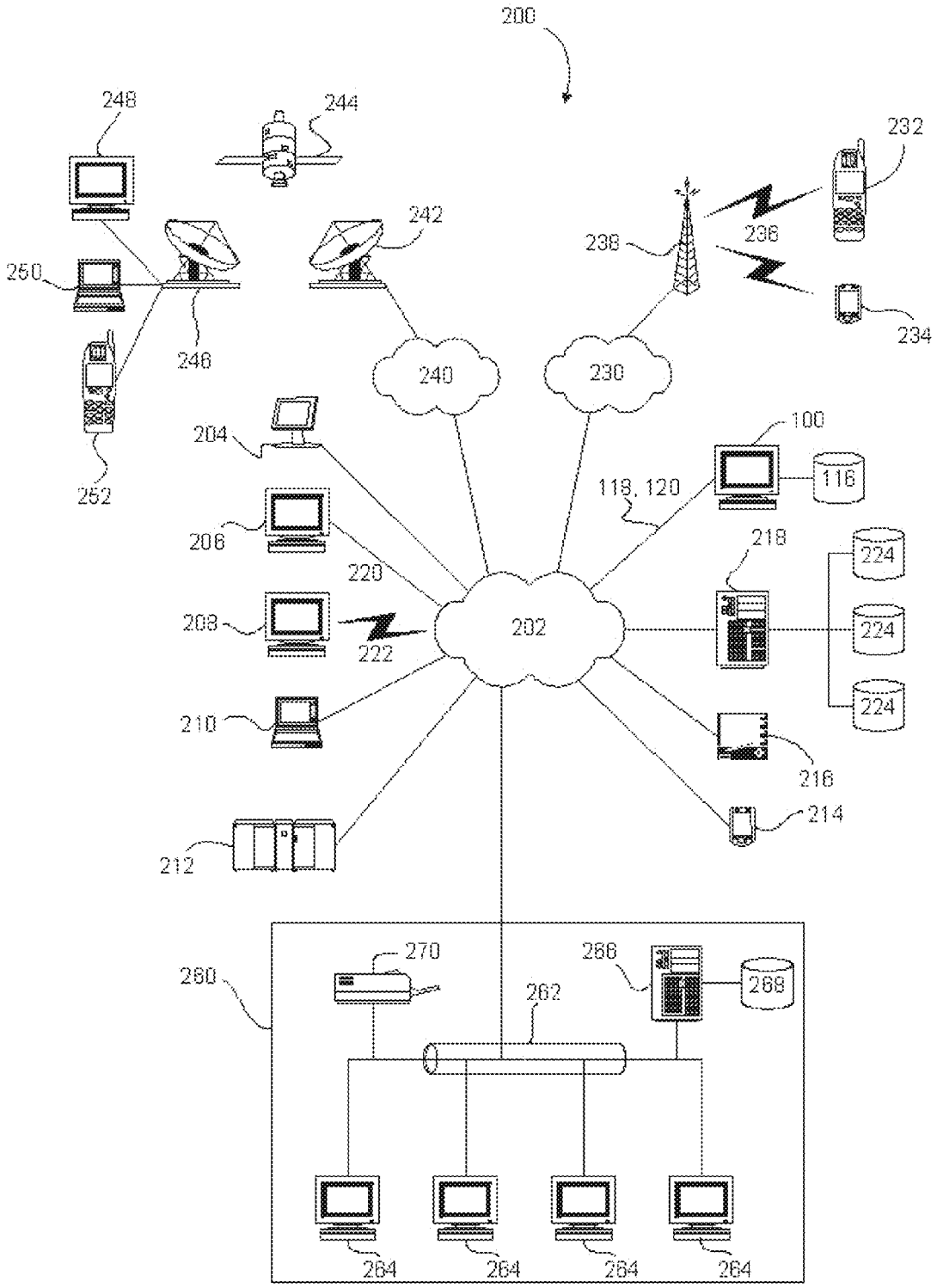
FIG. 3 illustrates an example network infrastructure that can be utilised to embody or give effect to a particular embodiment of a communications network useable by the personal alarm system of FIG. 1.

Referring now to FIG. 2, the processing system 100 generally includes at least one processor 102, or processing unit or plurality of processors, memory 104, at least one input device 106 and at least one output device 108, coupled together via a bus or group of buses 110.

In certain embodiments, input device 106 and output device 108 could be the same device, e.g. a touchscreen. An interface 112 can also be provided for coupling the processing system 100 to one or more peripheral devices or to a communications network 200 (described in more detail below), for example interface 112 could be a PCI card or PC card. At least one storage device 114 which houses at least one database 116 can also be provided. The memory 104 can be any form of memory device, for example, volatile or non-volatile memory, solid state storage devices, magnetic devices, etc. The processor 102 could include more than one distinct processing device, for example to handle different functions within the processing system 100.

Input device 106 receives input data 118 and can include, for example, a keyboard, a pointer device such as a pen-like device or a mouse, audio receiving device for voice-controlled activation such as a microphone, data receiver or antenna such as a modem or wireless data adaptor, data acquisition card, a touchscreen for receiving tactile input, etc. Input data 118 could come from different sources, for example keyboard instructions in conjunction with data received via a network. Output device 108 produces or generates output data 120 and can include, for example, a display device or monitor in which case output data 120 is visual, a printer in which case output data 120 is printed, a port for example a USB port, a peripheral component adaptor, a data transmitter or antenna such as a modem or wireless network adaptor, etc. Output data 120 could be distinct and derived from different output devices, for example a visual display on a monitor in conjunction with data transmitted to a network.

A user could view data output, or an interpretation of the data output, on, for example, a monitor or using a printer. The storage device 114 can be any form of data or information storage means, for example, volatile or non-volatile memory, solid state storage devices, magnetic devices, etc.

In use, the processing system 100 is adapted to allow data or information to be stored in and/or retrieved from, via wired or wireless communication means, the at least one database 116. The interface 112 may allow wired and/or wireless communication between the processing unit 102 and peripheral components that may serve a specialised purpose. The processor 102 receives instructions as input data 118 via input device 106 and can display processed results or other output to a user by utilising output device 108. More than one input device 106 and/or output device 108 can be provided. It should be appreciated that the processing system 100 may be any form of terminal, server, specialised hardware, or the like.

Similarly, the communications network 200 can comprise a mobile telephony network, the internet or World Wide Web, and/or a radio network, etc. In general, in a networked information or data communications system, a user has access to one or more terminals which are capable of requesting and/or receiving information or data from local or remote information sources. In such a communications system, a terminal may be a type of processing system, computer or computerised device, personal computer (PC), mobile, cellular or satellite telephone, mobile data terminal, portable computer, Personal Digital Assistant (PDA), pager, thin client, wearable processing device, or any other similar type of digital electronic device.

The capability of such a terminal to request and/or receive information or data can be provided by software, hardware and/or firmware. A terminal may include or be associated with other devices, for example a local data storage device such as a hard disk drive or solid state drive.

An information source can include a server, or any type of terminal, that may be associated with one or more storage devices that are able to store information or data, for example in one or more databases residing on a storage device. The exchange of information (i.e., the request and/or receipt of information or data) between a terminal and an information source, or other terminal(s), is facilitated by a communication means. The communication means can be realised by physical cables, for example a metallic cable such as a telephone line, semi-conducting cables, electromagnetic signals, for example radio-frequency signals or infra-red signals, optical fibre cables, satellite links or any other such medium or combination thereof connected to a network infrastructure.

The network infrastructure of the communications network 200 can include devices such as a telephone switch, base station, bridge, router, or any other such specialised network component, which facilitates the connection between a terminal and an information source. Collectively, an interconnected group of terminals, communication means, infrastructure and information sources is referred to as a network.

The network 200 itself may take a variety of forms. For example, it may be a computer network, telecommunications network, data communications network, Local Area Network (LAN), Wide Area Network (WAN), wireless network, Internetwork, Intranetwork, the Internet and developments thereof, transient or temporary networks, combinations of the above or any other type of network providing for communication between computerised, electronic or digital devices.

More than one distinct network can be provided, for example a private and a public network. A network as referenced in this specification should be taken to include any type of terminal or other similar type of electronic device, or part thereof, which is rendered such that it is capable of communicating with at least one other terminal.

Processing system 100 could connect to network 202, for example the Internet or a WAN. Input data 118 and output data 120 could be communicated to other devices via network 202. Other terminals, for example, thin client 204, further processing systems 206 and 208, notebook computer 210, mainframe computer 212, PDA 214, pen-based computer 216, server 218, etc., can be connected to network 202. A large variety of other types of terminals or configurations could be utilised. The transfer of information and/or data over network 202 can be achieved using wired communications means 220 or wireless communications means 222. Server 218 can facilitate the transfer of data between network 202 and one or more databases 224.

Other networks may communicate with network 202. For example, telecommunications network 230 could facilitate the transfer of data between network 202 and mobile or cellular telephone 232 or a PDA-type device 234, by utilising wireless communication means 236 and receiving/transmitting station 238. Satellite communications network 240 could communicate with satellite signal receiver 242 which receives data signals from satellite 244 which in turn is in remote communication with satellite signal transmitter 246.

Terminals, for example further processing system 248, notebook computer 250 or satellite telephone 252, can thereby communicate with network 202. A local network 260, which for example may be a private network, LAN, etc., may also be connected to network 202. For example, network 202 could be connected with Ethernet 262 which connects terminals 264, server 266 which controls the transfer of data to and/or from database 268, and printer 270. Various other types of networks could be utilised.

The processing system 100 is adapted to communicate with other terminals, for example further processing systems 206, 208, by sending and receiving data, 118, 120, to and from the network 202, thereby facilitating possible communication with other components of the networked communications system 200.

Thus, for example, the networks 202, 230, 240 may form part of, or be connected to, the Internet, in which case, the terminals 206, 212, 218, for example, may be web servers, Internet terminals or the like. The networks 202, 230, 240, 260 may be or form part of other communication networks, such as LAN, WAN, Ethernet, token ring, FDDI ring, star, etc., networks, or mobile telephone networks, such as GSM, CDMA or 3G, etc., networks, and may be wholly or partially wired, including for example optical fibre, or wireless networks, depending on a particular implementation.

In light of the above description, monitoring arrangement 12 and an example of the mobile monitor 24 can be realised in a variety of different ways. Typically, the monitoring arrangement 12 is a processing system 100, with the mobile monitor 24 being a processing system adapted for convenient mobility on the person of a user. In one example, such a processing system 100 may include a mobile telephone arrangement 214, with or without ancillary accessories. In another example, the mobile monitor 24 comprises a discrete processing system with network interface, such as a wearable device with mobile network access, or the like.

The monitoring arrangement 12 is typically configured to provide an electronic portal, such as a webpage, whereby a user is able to register a user profile 26 on the user database 14, and to associate a particular mobile monitor 24 with such profile. Accordingly, as a personal alarm system 10, such a user profile 26 can include any relevant information to emergency assistance 30, including allergies, previous surgeries, heart conditions, Alzheimer's, diabetes, cancer, HIV status, etc. It is also to be appreciated that populating such user profile 26 with information may be done by the user, or by an agent such as a doctor, or the like.

Typically, the distress signal generated by the mobile monitor 24 comprises an identifier for uniquely identifying the user profile 26 associated with that monitor 24. In one example, the emergency assistance 30 dispatched by the dispatcher 18 upon receipt of the distress signal is dependent on a pre-registered emergency assistance requirement registered on that particular user profile. In another example, the distress signal generated by the mobile monitor 24 is indicative of a type of emergency assistance 30 required by the user. In general, a type of emergency assistance 30 is selected from a group consisting of medical assistance, police assistance, fire services and private security assistance.

For example, if a user suffers from a heart condition and may be prone to distress situations requiring suitable medical aid, such condition and medical aid requirements can be registered on the user's profile 26. Should the monitoring arrangement 12 receive a distress signal from that user, qualified medical assistance can be dispatched to the user's location.

In one example, the dispatcher 18 comprises a call centre. In another example, the dispatcher 18 comprises the processing system 100 which has been configured to automatically dispatch the emergency assistance, typically based on requirements registered on the particular user profile.

In one example, the mobile monitor 24 includes a global navigation satellite system (GNSS) sensor to facilitate indication of the geospatial position 28 of the mobile monitor 24. In another example, the monitoring arrangement 12 and/or communications network 200 is configured to radiolocate the geospatial position 28 of the mobile monitor 24 based on reception of the distress signal. The skilled addressee will appreciate that radiolocation and its derivatives generally refer to the determination of a position of an object, such as the mobile monitor, by means of the propagation properties of electromagnetic waves, such as the distress signal, and include any suitable radiodetermination techniques.

A further application of the alarm system 10 includes geo-fencing, being a virtual perimeter for a real-world geographic area, where such a virtual geo-fence can be established either virtually, using the global navigation satellite system (GNSS), or physically by means of geo-fencing markers, as is known in the art, that activate when the mobile monitor 24 passes through them. Such a virtual geo-fence can be associated with the user profile on the user database. In one example, the mobile monitor 24 is configured to generate the distress signal in accordance with the global navigation satellite system (GNSS) sensor sensing that the geospatial position is outside of a preconfigured geo-fence associated with the user profile on the user database.

In another example, the monitoring arrangement 12 is configured to dispatch emergency assistance upon detecting that the geospatial position of the mobile monitor 24 is outside a preconfigured geo-fence associated with the user profile on the user database. To this end, the monitoring arrangement 12 can be configured to periodically poll the geospatial position of the mobile monitor 24, or the like. Various configurations and methodologies are known in the art and the skilled addressee will appreciate that various modifications thereof can be used with the invention described herein.

Applicant believes it particularly advantageous that such geo-fencing application of the present invention can facilitate in preventing infirm people, such as dementia sufferers, from moving out of a specific area and then getting lost, or the like.

Figure 4:
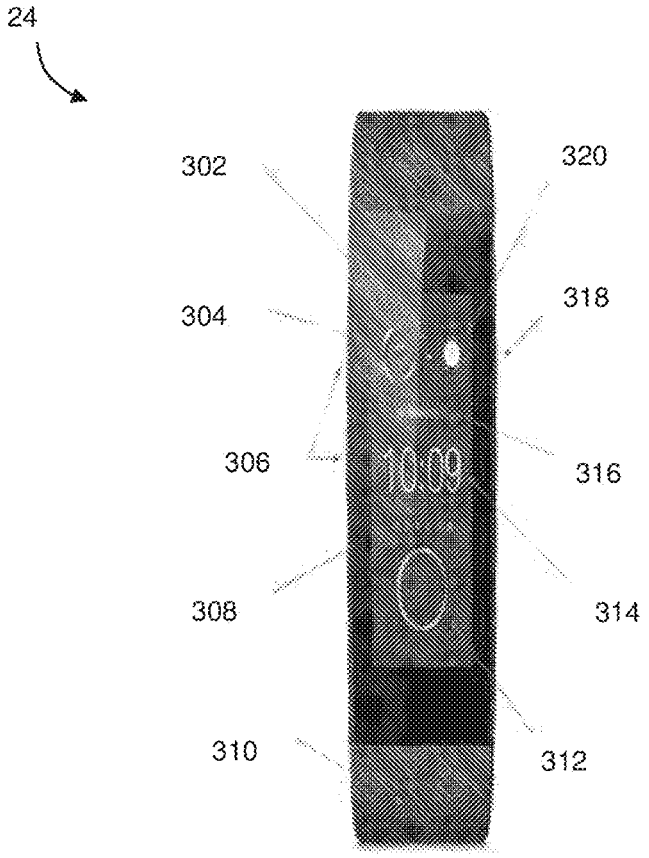
FIG. 4 is a diagrammatic representation of one embodiment of a mobile monitor of FIG. 1.

With reference now to FIG. 4 of the accompanying drawings, there is shown one example of the mobile monitor 24 for the personal alarm system 10. In general, the mobile monitor 24 comprises a housing configured for convenient mobility on a user's person, such as a wrist watch or pendant, or the like. In this example, the monitor is configured as a wristwatch-type device.

The monitor 24 also includes a processing system 100, as described broadly above, arranged within the housing and configured to enable generation and subsequent transmission of the distress signal via the communications network 200. As described earlier, the distress signal is indicative of a profile 26 of the user pre-registered on the user database 14 of the monitoring arrangement 12.

It is to be appreciated that, in other examples, the monitor 24 may comprise a software application running on a mobile phone of a user. In this example, the mobile phone becomes the monitor 24, as will be appreciated by the skilled addressee. Similarly, in another example, the monitor 24 may comprise a wristwatch-type device configured to interface with a mobile handset of the user via frequency-hopping spread spectrum electromagnetic wave technology, e.g. Bluetooth, or the like. In such an example, certain features of the monitor may be performed by the wrist-worn device, whilst others are performed by the mobile phone. Similarly, another example has all features incorporated into the wristwatch-type device, including mobile phone telephony capabilities.

In one example, the mobile monitor 24 is configured to generate the distress signal upon direct user input, e.g. a button or switch 312. In one example, the mobile monitor 24 includes a microphone 308 with the user input being a user-programmable emergency phrase which causes the mobile monitor 24 to generate the distress signal. In one example, the mobile monitor 24 includes an activating switch 312 so that a user is able to manually activate generation of the distress signal.

In one example, the mobile monitor 24 includes a detector for sensing a particular medical condition of the user, detection of which causes automatic generation of the distress signal. Typically, the detector may be configured to detect a user's heart-rate, blood pressure, blood sugar levels, electrical impulses, and/or the like.

In this example, the mobile monitor 24 includes a camera 304 with accompanying focus 302 configured to transmit an image to the monitoring arrangement 12. The camera 304 can facilitate video telephony with the monitoring arrangement 12, and/or can also be used to capture an image of a cause of an emergency situation, e.g. a user being attacked by an assailant, or the like. The mobile monitor 24 also includes a display 314 configured to receive an image from the monitoring arrangement 12. The display 314 can also display other features, such as the time.

In one example, the mobile monitor 24 also includes a notifier configured to notify the user of an occurrence. Typically, the notifier includes an audible and/or visual and/or haptic notification means. Accordingly, the notifier may include the display 314, a speaker, a vibrating motor, etc. In one example, the occurrence comprises the detector sensing a particular medical condition. In another example, the occurrence comprises a notification from the monitoring arrangement 12. In a yet further example, the occurrence comprises an automatic and scheduled reminder notification for taking medication.

In one example, the mobile monitor 24 includes an inclinometer (not shown) configured to detect a change and/or a rate of change in orientation of the user's person, detection of a specific change and/or rate of change which causes automatic generation of the distress signal. Such an inclinometer can include any suitable instrument for measuring angles of slope (or tilt), elevation or depression of an object with respect to gravity. Such inclinometers found in modern smartphones may perform this function, or this feature may be incorporated in a discrete wristwatch-type mobile monitor 24.

For example, a user may suffer a medical emergency and lose consciousness or faint, typically falling down. The mobile monitor 24 can sense such an event and generate and transmit the distress signal automatically, or initiates an escalation procedure, as described in more detail below. In such a manner, any unexpected or unauthorised changes in a user's body position, e.g. falling down, can trigger the distress signal.

The example of the wristwatch-type monitor 24 shown in FIG. 4 also includes volume adjustment buttons 306, speaker 308, a wrist band 310, the push-button alert switch 312, the display with time 314, the microphone 316, an on/off switch 318, and an ambient light meter 320 for automatically adjusting a brightness of the display 314. Other components can also be included, depending on requirements, as will be appreciated by the skilled addressee.

In use, when the mobile monitor 24 generates and transmits a distress signal to the monitoring arrangement 12, the monitoring arrangement 12 can identify the user from the signal received. Any assistance requirements, such as medical preconditions which have been registered against that user's profile 26, along with the name, number and location of the nearest emergency responders, any noted second party people the user has nominated for backup notification, in case of emergency contacts, etc., can be easily located. The user's geospatial position 28 can also be determined.

In one example, a voice and/or video call can be established between the monitoring arrangement 12 and the mobile monitor 24 that transmitted the distress signal. In a further example, the system 10 can be configured for a pre-set automated awareness call that, if missed by the user, defaults to a three-stage escalation procedure. If a third stage escalation fails, the system 10 will then automatically notify a nominated second party on the user's profile to check up on the user, for example.

Applicant believes it as particularly advantageous that the present invention provides a means whereby people who are alone are able to summon emergency assistance in a convenient manner. In addition, a further advantage is that the system 10 includes monitoring of a user whereby emergency assistance can be automatically summoned in situations where the user is unable to. Importantly, the system 10 enables user's thereof to move about unencumbered, as the mobile monitor 24 is conveniently mobile and is configured to rely on existing mobile telephone networks, allowing safe movement anywhere where there is mobile telephone reception.

The present invention further provides for immediate communication in case of an emergency, as a user is able to establish communication, e.g. voice and video call, with the monitoring arrangement 12.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

It is to be appreciated that reference to "one example" or "an example" of the invention, or similar exemplary language (e.g., "such as") herein, is not made in an exclusive sense. Various substantially and specifically practical and useful exemplary embodiments of the claimed subject matter are described herein, textually and/or graphically, for carrying out the claimed subject matter.

Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. A mobile monitor for a personal alarm system, said mobile monitor comprising:

a housing configured for convenient mobility on a user's person;

a processing system arranged within the housing, said processing system configured to enable generation and subsequent transmission of a distress signal via a communications network, said signal indicative of a profile of the user pre-registered on a user database of an associated monitoring arrangement having a dispatcher configured to dispatch emergency assistance upon receipt of said distress signal, the distress signal further indicative of a geospatial position of the mobile monitor; and a detector arranged in signal communication with the processing system and configured for sensing one or more of a user's heart-rate, blood pressure, blood sugar levels, and electrical impulses of said user, unexpected changes to any of which causes automatic generation of the distress signal, the detector being further configured to generate the distress signal upon detecting a user-programmable emergency phrase.

2. The mobile monitor of claim 1, wherein the distress signal generated by the mobile monitor is indicative of a type of emergency assistance required by the user.

3. The mobile monitor of claim 1, which includes a global navigation satellite system (GNSS) sensor to facilitate indication of the geo spatial position of the mobile monitor, the monitor configured to generate the distress signal in accordance with the global navigation satellite system (GNSS) sensor sensing that the geospatial position is outside of a preconfigured geo-fence associated with the user profile on the user database.

4. The mobile monitor of claim 1, which is configured for convenient mobility on a user's person by comprising a software application running on a mobile handset of the user or a device wearable by the user.

5. The mobile monitor of claim 1, which includes an inclinometer configured to detect a change and/or a rate of change in orientation of the user's person, detection of a specific change and/or rate of change which causes automatic generation of the distress signal.

6. The mobile monitor of claim 1, which includes a camera configured to transmit an image to the monitoring arrangement.

7. The mobile monitor of claim 1, which includes a display configured to receive an image from the monitoring arrangement.

8. The mobile monitor of claim 1, which includes a notifier configured to notify the user of an occurrence, the notifier including an audible and/or visual and/or haptic notification means, the occurrence comprising the detector sensing a particular medical condition and/or an automatic and scheduled reminder notification for taking medication.

9. A distributed personal alarm system comprising:

a monitoring arrangement comprising a user database, a receiver configured to receive a distress signal via a communications network, and a dispatcher configured to dispatch emergency assistance upon receipt of a distress signal; and at least one mobile monitor pre-associated with a user profile in the user database, the monitor configured for convenient mobility on a user's person, and to generate and transmit the distress signal via the communications network, said signal indicative of the user profile and a geospatial position of the mobile monitor, wherein the mobile monitor includes a detector for sensing one or more of a heart-rate, blood pressure, blood sugar levels, electrical impulses, and/or a body orientation of the user, unexpected changes to any of which causes automatic generation of the distress signal, wherein the emergency assistance dispatched by the dispatcher upon receipt of the distress signal is dependent on a pre-registered emergency assistance requirement registered on the user profile.

10. The alarm system of claim 9, wherein the distress signal generated by the mobile monitor is indicative of a type of emergency assistance required by the user.

11. The alarm system of claim 9, wherein the monitoring arrangement and/or communications network is configured to radiolocate the geospatial position of the mobile monitor based on reception of the distress signal.

12. The alarm system of claim 11, wherein the mobile monitor is configured to generate the distress signal in accordance with the global navigation satellite system (GNSS) sensor sensing that the geospatial position is outside of a preconfigured geo-fence associated with the user profile on the user database.

13. The alarm system of claim 9, wherein the monitoring arrangement is configured to dispatch emergency assistance upon detecting that the geospatial position is outside a preconfigured geo-fence associated with the user profile on the user database.

14. The alarm system of claim 9, wherein the mobile monitor is configured to generate the distress signal upon direct user input.

15. The alarm system of claim 9, wherein the mobile monitor includes an activating switch so that a user is able to manually activate generation of the distress signal.

16. The alarm system of claim 9, wherein the mobile monitor includes an audible and/or visual and/or haptic notifier configured to notify the user of a notification from the monitoring arrangement being an automatic and scheduled reminder notification for taking medication.

17. The alarm system of claim 9, wherein the detector includes an inclinometer or accelerometer configured to detect a change and/or a rate of change in orientation of the user's person, such detection of a specific change and/or rate of change configured to automatically generate the distress signal.

* * * * *